United States Patent [19]

Rosenthal

[11] 4,426,021

[45] Jan. 17, 1984

[54] OPTICAL ILLUSION BEVERAGE DISPENSING DEVICE

[76] Inventor: L. Kenneth Rosenthal, 10306 Rossbury Pl., Los Angeles, Calif. 90064

[21] Appl. No.: 318,600

[22] Filed: Nov. 5, 1981

[51] Int. Cl.[3] ..... B67D 1/00; G09F 19/00

[52] U.S. Cl. ..... 222/129.1; 40/439; 40/442; 272/8 D

[58] Field of Search ..... 222/129.1, 333, 334, 222/420, 422, 383, 644, 109, 78; 272/8 R, 8 D, 8 P; 40/406, 407, 409, 439, 441, 442; 362/811, 806, 96; 239/18, 20, 23; 141/69, 70, 94, 98, 392

[56] References Cited

U.S. PATENT DOCUMENTS

| | | | |
|---|---|---|---|
| 1,536,188 | 5/1925 | Brown | 40/406 |
| 1,672,910 | 6/1928 | Saalburg | 40/406 |
| 1,673,696 | 6/1928 | Merry | 222/109 |
| 2,531,002 | 11/1950 | Sisk | 239/20 X |
| 3,387,782 | 6/1968 | Mizuno | 362/96 X |
| 4,030,634 | 6/1977 | Osborn | 222/23 |
| 4,250,537 | 2/1981 | Roegner et al. | 362/811 X |
| 4,265,402 | 5/1981 | Tsai | 272/8 P X |

FOREIGN PATENT DOCUMENTS

| | | | |
|---|---|---|---|
| 113452 | 7/1941 | Australia | 40/406 |

*Primary Examiner*—Joseph J. Rolla
*Assistant Examiner*—Kevin P. Shaver
*Attorney, Agent, or Firm*—L. Kenneth Rosenthal

[57] ABSTRACT

The invention relates to creating the illusion in a beverage dispensing device of liquid droplets that fill a drinking glass despite their appearance of rising from the drinking glass. The illusion is accomplished by oscillating the liquid and then applying a flashing light source whose frequency is slightly greater than the liquid oscillations. The enclosure and curtains of the invention allow the illusion to be viewed under certain conditions in room lighting. Also, under certain conditions an optical surface is attached to the enclosure which visually masks the ambient light.

10 Claims, 3 Drawing Figures

OPTICAL ILLUSION BEVERAGE DISPENSING DEVICE

BACKGROUND OF THE INVENTION

1. Field of the Invention

The invention relates to a beverage dispensing device which creates the illusion of liquid droplets which appear to rise despite the act of filling a drinking glass.

2. Description of the Prior Art

Flashing light sources and stroboscopic techniques have been used to create the illusion of stopped and reversed motion on apparatus moving or spinning at a high repetitive rate. A fan, for example, spinning at a high rate of speed which is invisible to the eye can be made to appear to be stopped or moving at a slow rate, backwards or forwards, by applying a flashing light source. A detailed explanation of these effects is disclosed in *Electronic Flash, Strobe* by Harold Edgerton, MIT Press, Cambridge, Mass., 1979.

If the flashing light source is pulsed at a very high frequency, the eye may be tricked into perceiving a constantly illuminated source. A movie projector actually flashes at 24 frames per second although the eye only perceives a continuously lighted screen. As the intensity of the individual flash increases, the number of flashes per second necessary to give the illusion of constant illumination also increases in a nonlinear fashion. Information on the flicker-fusion phenomena is disclosed in Cornsweet, T. N., *Visual Perception,* Academic Press, N.Y., 1970, and Gregory, R. L., *Eye and Brain,* McGraw-Hill, N.Y., 1973.

It is known in the prior art that the limitations of the electro-optical systems of stroboscopes dictate very low light levels as the frequency of pulsation increases. If a test engineer is studying the motion of a shaft turning at the high rate of 6000 revolutions per minute with the aid of a strobe flashing at nearly the same rate, he will be able to freeze the motion of the shaft only partly. Unless the environment is completely dark, the limited illumination available from the strobe at the high frequency will combine with the ambient light to present a combination of a blurred and nearly stationary shaft.

In the prior art no method has been devised to allow viewing the illusion of pulsed liquid droplets frozen in motion by the illumination of a flashing light source in nearly ambient or even dim lighting situations. Even under completely dark conditions a fluorescent dye must be added to the liquid for the illusion to be seen clearly.

SUMMARY

The invention relates to a beverage dispensing device which produces liquid droplets that fill a drinking glass while creating the illusion of the liquid droplets rising from the drinking glass. The invention stores liquid in a reservoir which is piped to an oscillating pump which applies pulsations to the liquid. A nozzle receives the liquid from the oscillating pump and converts the pulsations of the liquid to liquid droplets. These liquid droplets are illuminated by a flashing light source operating above the flicker-fusion frequency. An enclosure houses the reservoir, pipes, pump, nozzle and flashing light source, and prevents ambient light from striking the liquid droplets directly. The middle section of the enclosure has an optical surface attached to it which reflects and disperses the illumination from the flashing light source back through the liquid droplets. The enclosure also adds an aesthetic appeal and permits the invention to be displayed in hotels and restaurants and used for dispensing all types of beverages—liquor to soft drinks. Therefore, an object of the present invention is to provide a compact, quiet, lightweight, and portable beverage dispensing device which creates the illusion of rising liquid droplets which, however, fill a drinking glass.

A further object of the invention is to provide an enclosure which allows the illusion to be viewed fully under dim and ambient light.

A further object of the invention is to provide a hydraulic system which can transport most liquids and produce the illusion without the aid of fluorescent dyes.

A further object of the invention is to provide an enclosure which properly isolates the vibrations of the oscillating pump from the other parts of the invention so the liquid droplet rate is exactly repetitious.

Further objects and advantages of the invention will become apparent from the study of the following portion of the specification, the claims, and the attached drawings.

DESCRIPTION OF THE PREFERRED EMBODIMENTS

Figure 2:
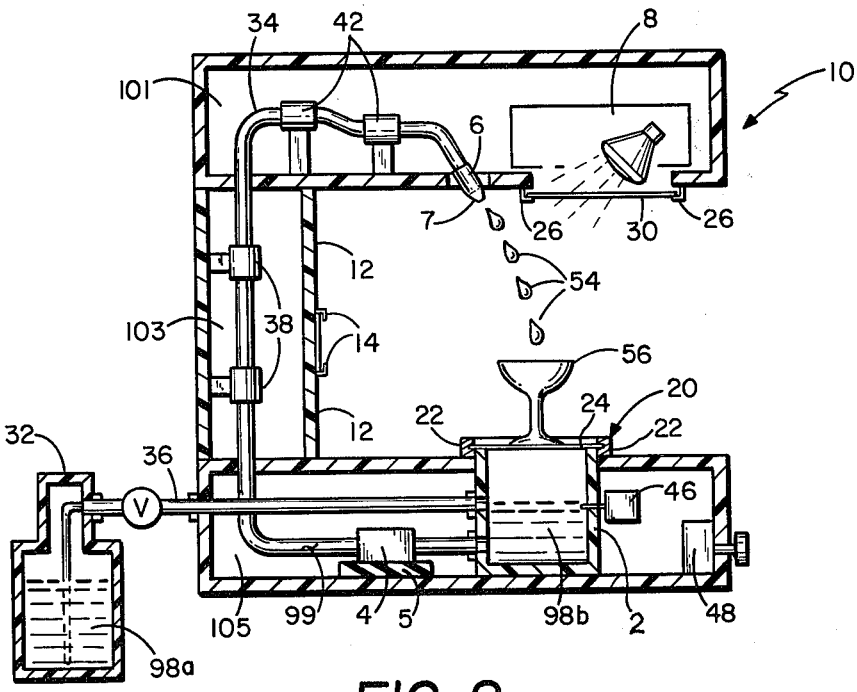
FIG. 2 is a sectional view taken along line 2—2 in FIG. 1.

In FIG. 2 container liquid 98*a* is pumped from container 32 through container pipe 36 when level detector 46 indicates reservoir liquid 98*b* is below a predetermined level. Oscillating pump 4 removes liquid 98*b* from reservoir 2 and adds oscillations to reservoir liquid 98*b* before vibrating liquid 99 travels in pipe 34 to nozzle 6. Rubber pad 5 prevents the mechanical oscillations of oscillating pump 4 from shaking enclosure 10. Pipe holders 38 strap pipe 34 to enclosure 10 securely so the vibrations of vibrating liquid 99 do not vibrate pipe 34. Pipe supports 42 also prevent pipe 34 from oscillating and provide precise orientation of nozzle 6. Optical holders 26 attach to enclosure 10 and lock optical element 30, which may be a color filter or lens system which converge, diverge, or scatter the light, in place in front of flashing light source 8. The color filter can add an aesthetically pleasing color to the liquid droplets. The lens system which converges and disperses the light from the flashing light source can enhance the illusion by providing for a different scattering light pattern on the liquid droplets.

As vibrating liquid 99 passes through nozzle 6 it is broken up due to increased vibrating liquid 99 velocity in the narrowed nozzle tip 7. The resulting liquid droplets 54 then pass to drinking glass 56 which is setting on structure 20. Structure 20, which consists of screen 24 (this screen 24 may be plastic or metallic—it must be porous) and rectangular members 22, also prevents splashing of liquid droplets when drinking glass 56 is removed and prevents viewing of reservoir 2.

Illumination from flashing light source 8 first passes through liquid droplets 54 and then hits optical surface 12 which disperses and reflects light back through liquid droplets 54. The light reflected from optical surface 12 greatly enhances the illumination of liquid droplets 54 and the illusion. Optical surface 12 may be a white flat or lightly colored board as to maximize reflection, diffusion, and scatter. Optical surface 12 can also be curved.

Figure 1:
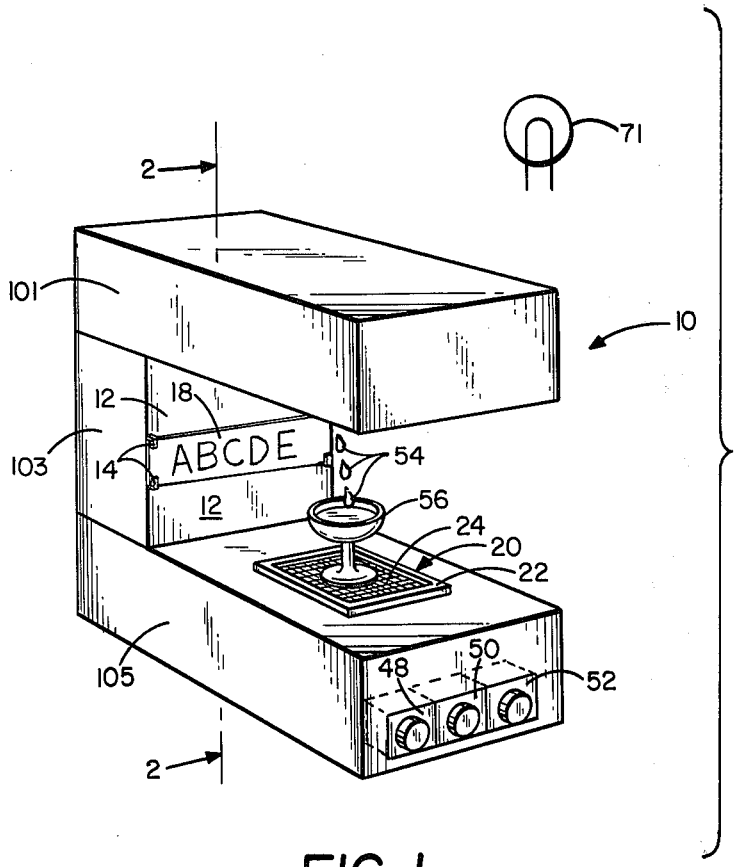
FIG. 1 is a perspective view of the optical illusion beverage dispensing device.

In FIG. 1 sign holders 14 lock in sign 18 of the company ABCDE. Care should be taken to make sure that sign 18 is a light reflective and diffusive color or else is not too large in relation to optical surface 12. Power electronic unit 48 turns the power of the invention on and off; Pump electronic unit 50 adjusts the power and frequency of the oscillating pump 4; and Illumination electronic unit 52 adjusts the flash rate of the flashing light source 8. The important consideration is that flashing light source 8 be operating above the flicker-fusion frequency and slightly greater than the oscillating pump 4 frequency. Power electronic unit 48 is connected to external power. Pump electronic unit 50 is hard wired to oscillating pump 4 and Illumination electronic unit 52 is connected to flashing light source 8.

Figure 3:
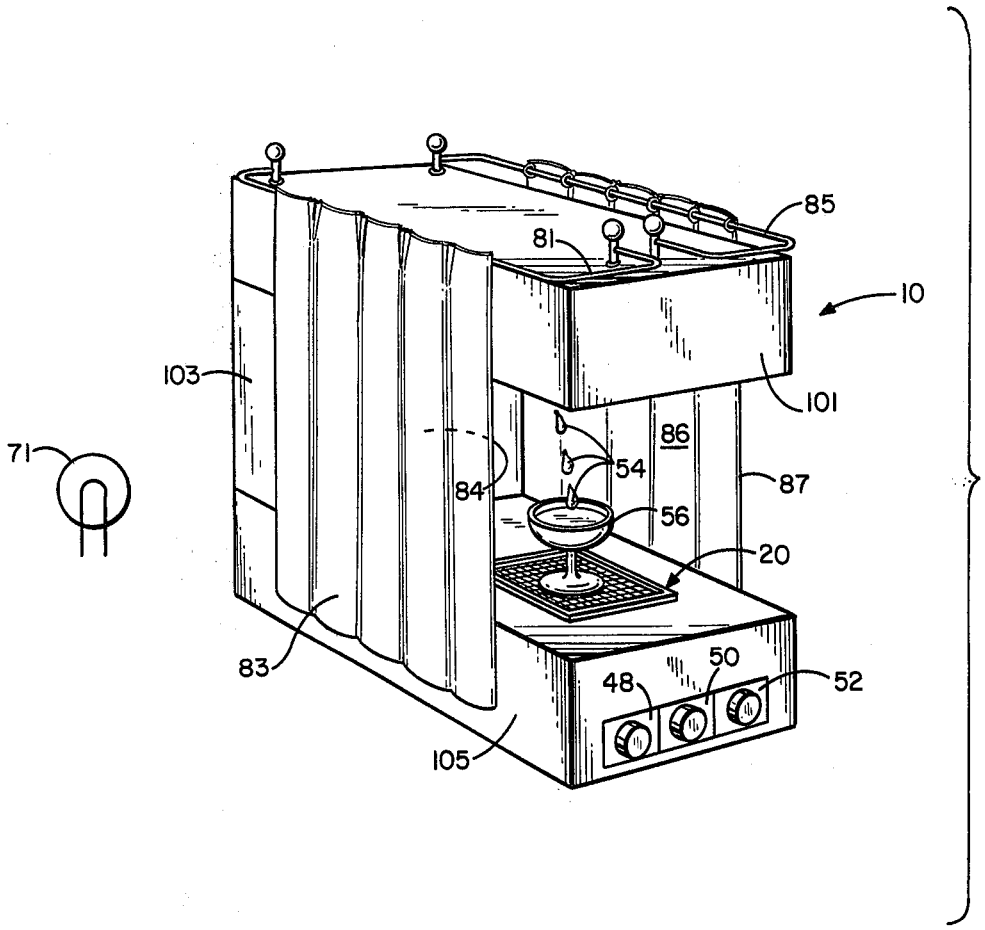
FIG. 3 is a perspective view of another embodiment of the invention which contains curtains.

FIG. 3 is another embodiment of the invention that would be used under certain ambient lighting situations. When ambient light 71 is close and bright left curtain 83 which is supported by left curtain holder 81 is drawn to block direct illumination of ambient light 71. Right curtain 87, supported by right curtain holder 85, is drawn when bright light sources are on the right side of enclosure 10. Also, right inside curtain section 86 and left inside curtain section 84 are colored white or a light color and act to reflect, disperse, and scatter the illumination from flashing light source 8. Right inside curtain section 86 and left inside curtain 84 function in the same manner as optical surface 12, as explained below, to visually mask ambient light 71, thereby enhancing the illusion.

In many situations where ambient light 71 is bright both curtains may not be needed. Top section 101 of enclosure 10 often casts a plurality of shadows on liquid droplets 54 which are sufficient to obtain an undegraded illusion. (Top section 101 is supported by middle section 103 which attaches to base 105 of enclosure.) The illumination from flashing light source 8 which is reflected off optical surface 12, which may be mounted on or in the proximity of middle section 103, seems to block or visually mask the perception of ambient light 71 that shines on liquid droplets 54. Also, if the ambient light is dim or far away optical surface 12 will not be necessary; enclosure 10 can often provide the proper environment for an undegraded illusion.

Another example of visual masking occurs when one goes to a movie theatre and the house lights are turned on brightly while the film is still playing, resulting in a loss of visual perception of the movie. One other human information processing phenomenon, selective focusing, or more popularly known as the cocktail effect, is also enhancing the illusion. The cocktail effect occurs when one is at a party and can listen to a voice that is further away while at the same time excluding closer and louder voices. When the illusion is being perceived, one focuses on the effect of the liquid droplets rising and becomes less sensitive to the ambient light 71.

The invention having been described in its preferred embodiments, it is clear that it is susceptible to numerous modifications and embodiments within the ability of those skilled in the art and without the exercise of the inventive faculty. Accordingly, the scope of the invention is defined by the scope of the following claims.

I claim:

1. A beverage dispensing device for a restaurant which produces liquid droplets that fill a drinking glass while creating the illusion of said liquid droplets rising from said drinking glass, comprising;

reservoir means which holds a liquid, oscillating pump means which receives said liquid from said reservoir means and applies pulsations to said liquid, nozzle means which receives said liquid from said oscillating pump means and convert said pulsations into said liquid droplets, flashing light source means which illuminates said liquid droplets and flashing light source being flashed at, or above the flicker-fusion frequency as to produce said illusion without flicker, enclosure means in which are mounted said reservoir means, said oscillating pump means, said nozzle means, and said flashing light source means, said enclosure means preventing ambient light from striking said liquid droplets thereby enhancing said illusion, and optical surface means mounted on said enclosure means, for reflecting and diffusing the illumination from said flashing light source means on said liquid droplets and visually masking said ambient light.

2. A beverage dispensing device for a restaurant which produces liquid droplets that fill a drinking glass while creating the illusion of said liquid droplets rising from said drinking glass, comprising;

a reservoir which holds a liquid, an oscillating pump which receives said liquid from said reservoir and applies pulsations to said liquid, a nozzle which receives said liquid from said oscillating pump and converts said pulsations into said liquid droplets, a flashing light source which illuminates said liquid droplets at, or above the flicker-fusion frequency, and an enclosure, in which is mounted said reservoir, said oscillating pump, said nozzle, and said flashing light source, said enclosure means preventing ambient light from striking said liquid droplets directly thereby enhancing the illusion.

3. The beverage dispensing device of claim 2 wherein an optical system is placed in front of the said flashing light source and acts to converge and disperse the light thereby enhancing said illusion.

4. The beverage dispensing device of claim 2, further comprising;

a first electronic system which applies power to said beverage dispensing device, a second electronic system which controls the frequency of said flashing light source, a third electronic system which applies power and frequency to said oscillating pump.

5. The beverage dispensing device of claim 2 wherein optical surface means reflect and diffuse the illumination from said flashing light source back through said liquid droplets and visually mask said ambient light thereby enhancing said illusion.

6. The beverage dispensing device of claim 5 in which said enclosure comprises;

a bottom section, a top section which casts a plurality of shadows on said liquid droplets, and a middle section which connects said bottom section to said top section, and an optical surface mounted on said middle section which reflects and diffuses said illumination from said flashing light source back through said liquid droplets and visually masks said ambient light thereby enhancing said illusion.

7. The beverage dispensing device of claim 5 wherein said optical surface is a white flat board.

8. The beverage dispensing device of claim 5 wherein said optical surface is a curved white board.

9. The beverage dispensing device of claim 2 wherein curtain means are drawn to block said ambient light, and inside sections of said curtain means reflect and scatter the illumination from said flashing light source and visually mask said ambient light thereby enhancing said illusion.

10. The beverage dispensing device of claim 9 wherein said inside sections of said curtain means are colored white.

* * * * *